US005103613A

United States Patent [19]

Kinoshita

[11] Patent Number: 5,103,613

[45] Date of Patent: Apr. 14, 1992

[54] FOUNDATION FOR WOODEN HOUSE

[76] Inventor: Satoru Kinoshita, 31, Aza-Hitotsuya, Goshogawara-shi, Aomori-ken, Japan

[21] Appl. No.: 653,890

[22] Filed: Feb. 11, 1991

[30] Foreign Application Priority Data

Aug. 30, 1990 [JP] Japan ..... 2-90097[U]

[51] Int. Cl.[5] ..... E02D 27/00

[52] U.S. Cl. ..... 52/292; 52/585; 52/584

[58] Field of Search ..... 52/292, 293, 294, 295, 52/296, 584, 585, 726

[56] References Cited

U.S. PATENT DOCUMENTS 605,468 6/1898 Bennett ..... 52/585

2,310,734 2/1943 Feldman ..... 52/585

*Primary Examiner*—Richard E. Chilcot, Jr.

*Assistant Examiner*—Wynn Wood

*Attorney, Agent, or Firm*—Ladas & Parry

[57] ABSTRACT

The present invention provides a foundation structure for a house in which adjacent members for constructing the foundation are joined to each other. Each foundation member has an end groove, formed in at least one end thereof, and a slim groove, formed in the upper portion of the foundation member, so that the slim groove communicates with the end groove. To join adjacent foundation members together, a binding member is received in the slim grooves and end grooves of adjacent foundation members so that a communicating groove is formed between the joined foundation members and that the binding member defines opposed recesses in the communicating groove to receive tenons provided on a pillar that is connectable to the foundation. Wedge-shaped portions on ends of the binding member cooperate with wedge-shaped recesses provided at ends of the slim groove so that the wedge-shaped portion and recesses, when the binding member is received in the foundation members, prevent the foundation members from being separated.

4 Claims, 5 Drawing Sheets 101
104
103
104

FOUNDATION FOR WOODEN HOUSE

BACKGROUND OF THE INVENTION

The present invention relates to a foundation for a wooden house.

In particular, the present invention relates to the foundation for a wooden house wherein joints between foundation members, and between foundation members and pillars, are improvements over the prior art.

In a conventional foundation for a wood house, adjacent foundation members 3, 4 are usually joined together by a tenon 4 on one member being received in a mortise 2 formed in an adjacent member. A problem with this construction is that care must be taken in forming the tenon and mortise so that the adjacent members are properly positioned when they are joined together.

Further, according to the conventional art, a mortise 6 is provided in an upper bed 5 of the member 1 for constructing the foundation and a penetrated mortise and tenon 8 of a pillar 7 is inserted into the mortise 6 of the upper bed 5 to build the pillar 7 on the upper bed 5 of the member 1 for constructing the foundation 1, wherein the pillar 7 built on the member 1 for constructing the foundation is reinforced by using a reinforcing metallic material (not shown). The joint between pillar 7 and foundation member 1 can also be reinforced by using a piling. The problem with such an arrangement is that care must taken to insure that mortise 6 and tenon 8 are properly dimensioned and positioned so that pillar 7 and member 1 are properly aligned with respect to one another when tenon 8 is received into mortise 6. The conventional foundation construction is illustrated in FIG. 1.

SUMMARY OF THE INVENTION

According to the present invention, the corresponding joint surfaces of both members for constructing the foundation are placed opposite each other, a plate main body of a binding member is dropped in opposed grooves and slim grooves provided on the joint surfaces of both members for constructing the foundation and the wedge-shaped portions at both ends of the binding member are also dropped in the wedge-shaped holes provided on both members for constructing the foundation, thereby realizing the joint of the foundation having the desirable length and measurement. In each joint surface a groove is formed so that when adjacent members for constructing the foundation are joined together by the binding member a communicating groove is formed that receives tenons on the pillar so that the pillar can be mounted to the foundation. The communicating groove is divided into two opposed recesses when the binding member is received in the adjacent members for constructing the foundation.

The binding member for joining the both members for constructing the foundation comprises the plate main body and the wedge-shaped portions at both ends and is formed by a metal or an engineering plastic.

DESCRIPTION OF THE PREFERRED EMBODIMENTS

The embodiments of the present invention are explained as follows based on the drawings.

Figure 1:
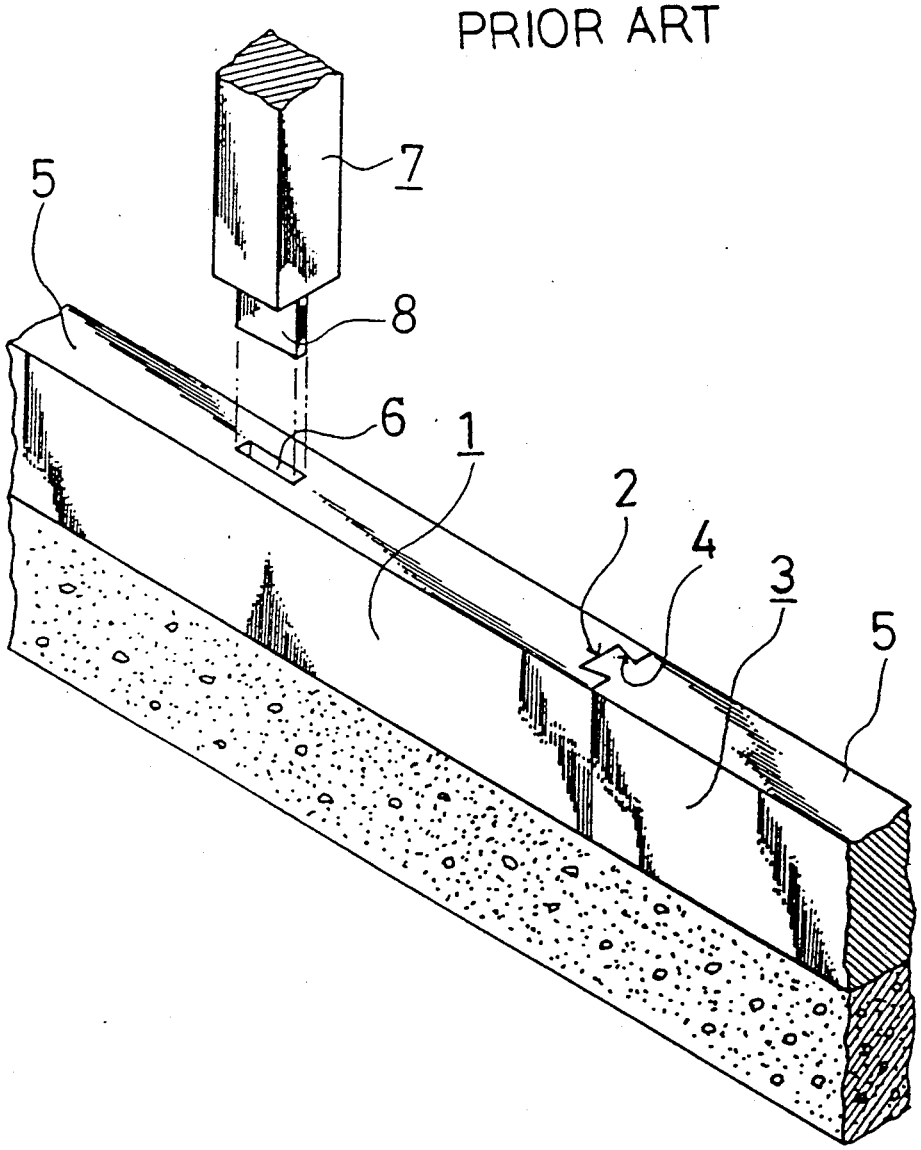
Fig.1 PRIOR ART
FIG. 1 is a perspective view for showing the conventional structure for the foundation and the structure for building the pillar.
Figure 2:
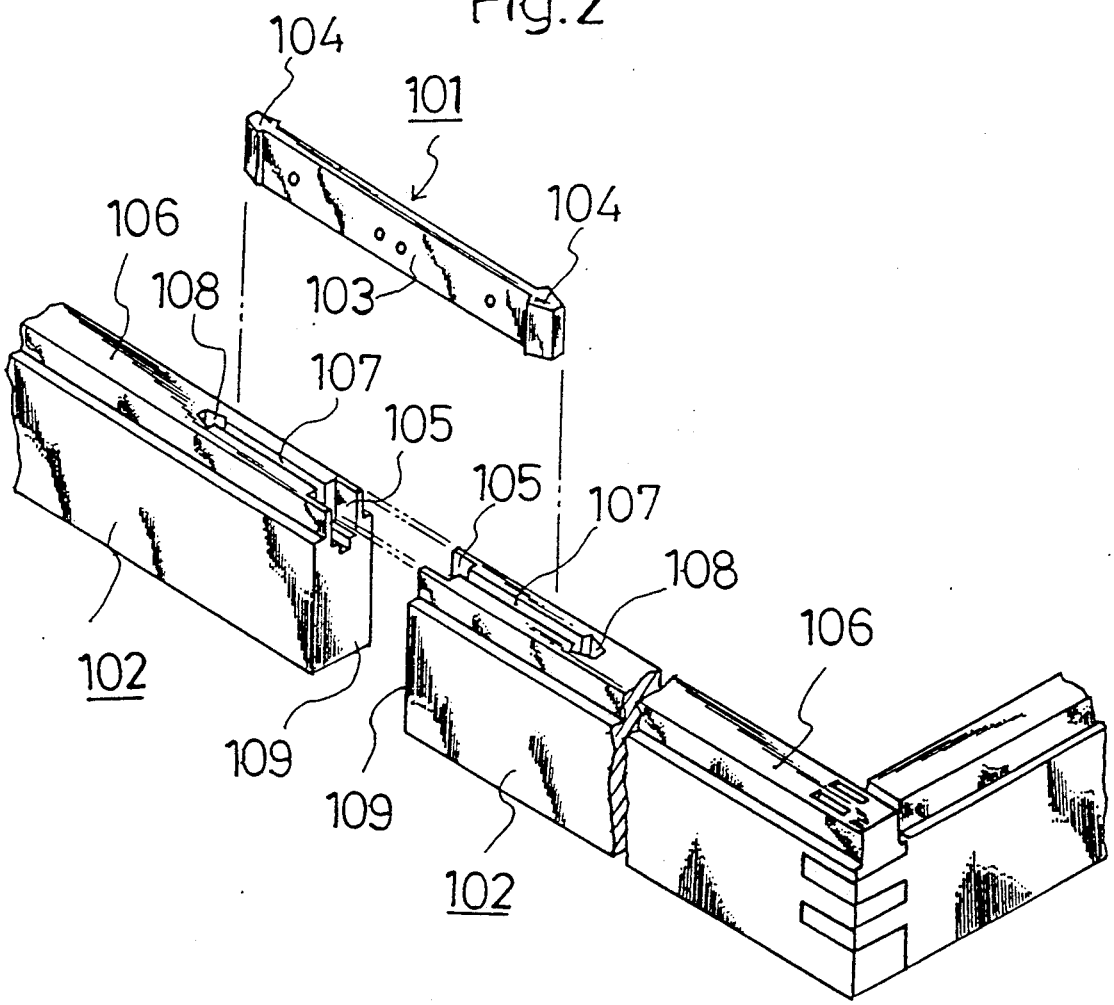
FIG. 2 is a separated perspective view for the structure for foundation according to the present invention.
Figure 3:
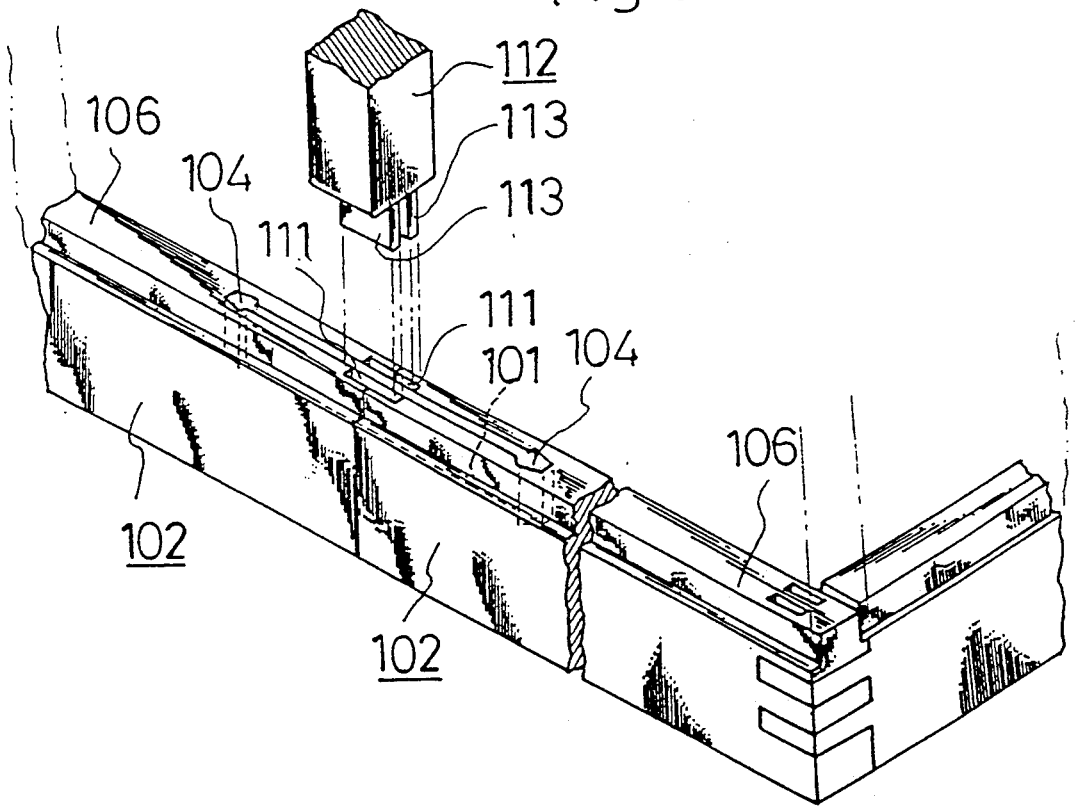
FIG. 3 is a perspective view for showing the joint structure for the foundation and the structure for building the pillar according to the present invention.
Figure 4:
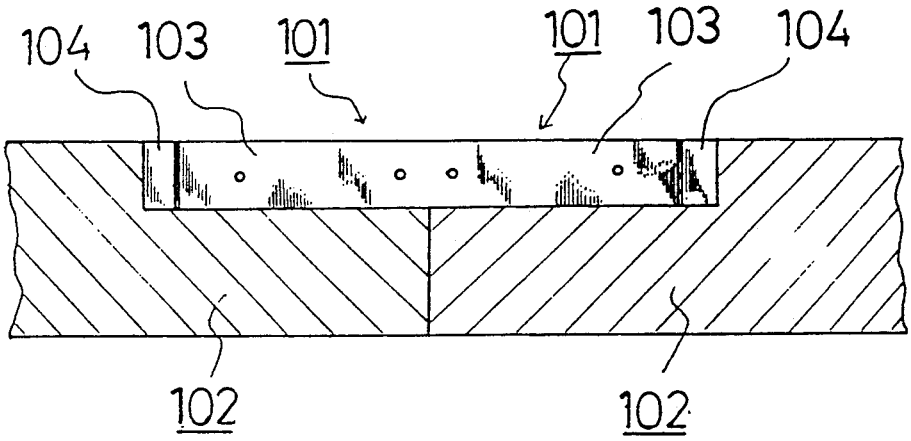
FIG. 4 is a sectional view for showing the joint structure for the foundation according to the present invention.
Figure 5:
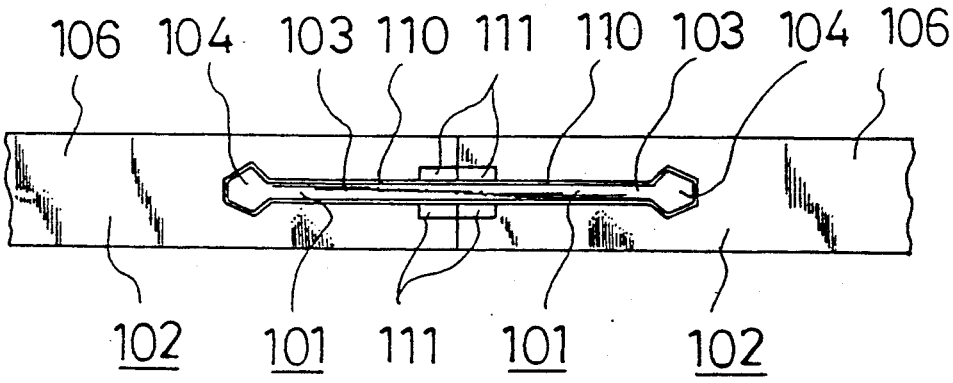
FIG. 5 is a top view for showing the joint structure for the foundation according to the present invention.
Figure 6:
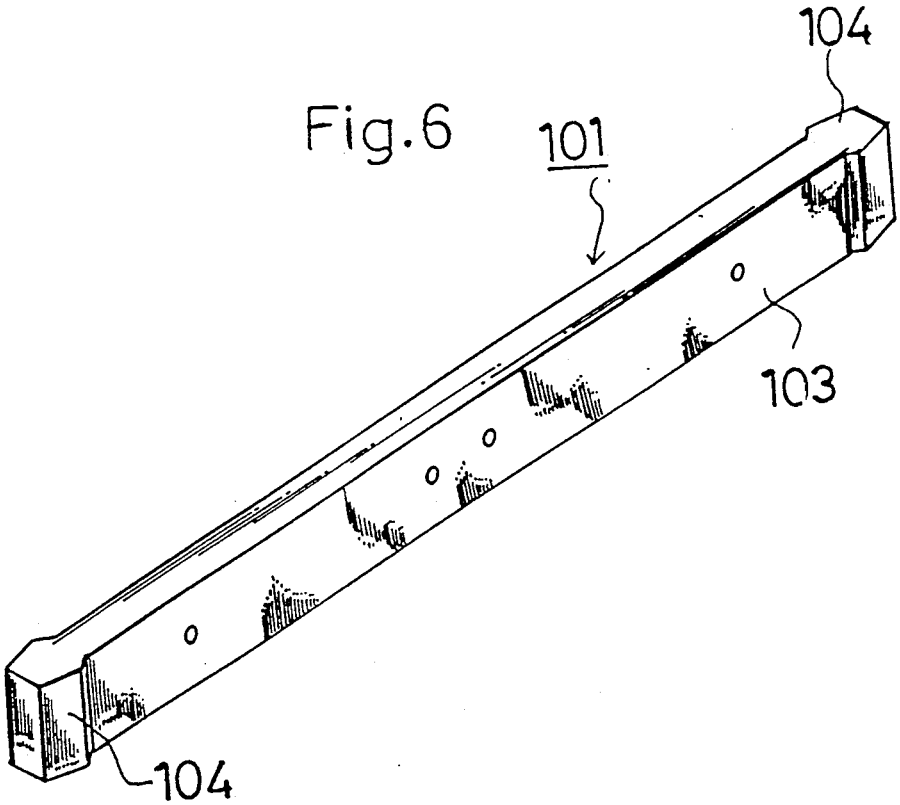
FIG. 6 is a perspective view for showing the binding member of the present invention.

In FIGS. 2 to 6, the reference numeral 101 is a binding member for joining the corresponding joint surfaces of adjacent members 102 for constructing the foundation. The binding member 101 is formed of a metal or a plastic and forms a plate main body 103 having wedge-shaped portions 104 at both ends.

An opposed groove 105 is provided on the corresponding joint surface of each member 102 for constructing the foundation, each opposed groove 105 is connected to a slim groove 107 for opening to the direction of an upper bed 106 of each member 102 for constructing the foundation, and each slim groove 107 is further connected to a wedge-shaped portion 108 for opening to the upper bed 106 of each member 102 for constructing the foundation.

In the present invention, the corresponding joint surface 109 on each member 102 for constructing the foundation faces the joint surface 109 on the adjacent member the plate main body 103 of the binding member 101 is dropped into the opposed grooves 105 and slim-grooves 107 which are provided in the joint surface 109 of each member 102 for constructing the foundation, and the wedge-shaped portions 104 at both ends of the binding member 101 are dropped into the wedge-shaped holes 108 which are provided on joint surface 109 of each member 102 for constructing the foundation so that adjacent members 102 are joined together.

When adjacent members 102 are joined together, grooves 105, on the joint surface 109 of each member 102, are brought together to form communicating groove 110. Since the plate main body 103 of the binding member 101 is inserted into the center of the communicating groove 110, the communicating groove 110 is separated into two holes 111 in which the plate main body 103 acts as a bulkhead. Therefore, a tenon 113 provided on a pillar 112 is inserted into such two holes 111, thereby building the pillar 112 on the member 102 for constructing the foundation.

As mentioned above, the present invention facilitates construction of a foundation by allowing foundation members to be easily joined together, and to be joined to pillars extending from the joined foundation members, without the need for the mortise and tenon construction used in a conventional foundation. Furthermore, the joint formed by the present invention has a good appearance and firmly connects adjacent foundation members together.

What is claimed is:

1. An apparatus for constructing a foundation for a house comprising:

foundation members having an end groove formed in at least one end thereof, and a slim groove formed in an upper portion of each foundation member so that said slim groove communicates with said end groove;

a binding member for joining together adjacent foundation members so that said end groove on each member communicates with the corresponding end groove on the adjacent member to form a communicating groove, said binding member being received in said slim groove and said communicating groove to define opposed recesses in said communicating groove to receive tenons provided on a pillar that is connectable to the foundation; and means on said binding member and said foundation members to prevent said foundation members from being separated from one another once said binding member has been received in said slim groove and communicating groove.

2. The apparatus according to claim 1, wherein said means to prevent said foundation members from becoming separated includes wedge-shaped portions on ends of said binding member that are receivable in complementary wedge-shaped recesses provided at ends of said slim groove.

3. The apparatus according to claim 2, wherein the binding member is formed of a plastics material.

4. The apparatus according to claim 3, wherein the binding member is formed of a metal.

* * * * *